United States Patent [19]

Stamp, Sr.

[11] Patent Number: 4,852,309

[45] Date of Patent: Aug. 1, 1989

[54] MODULAR PORCH FOR A MOBILE HOME

[76] Inventor: Homer M. Stamp, Sr., Box 93, Scott City, Mo. 63780

[21] Appl. No.: 203,905

[22] Filed: Jun. 8, 1988

[51] Int. Cl.[4] ..... E04H 14/00

[52] U.S. Cl. ..... 52/79.6; 52/66; 52/79.5; 52/183; 52/184

[58] Field of Search ..... 52/79.6, 79.5, 79.1, 52/66, 183, 184, 191

[56] References Cited

U.S. PATENT DOCUMENTS

| | | | |
|---|---|---|---|
| D. 148,808 | 2/1948 | MacDonald, Jr. | D12/104 |
| D. 171,244 | 1/1954 | Bergstrom | D12/104 |
| D. 176,166 | 11/1955 | Wait et al. | D12/104 |
| D. 177,086 | 3/1956 | Chase | D12/104 |
| D. 182,692 | 4/1958 | Scidel | D12/104 |
| D. 193,549 | 9/1962 | Zipinsky | D12/104 |
| D. 206,871 | 2/1967 | Thomas | D12/104 |
| D. 220,319 | 3/1971 | Gruner | D12/104 |
| 2,760,238 | 8/1956 | Lane | 52/79.6 |
| 3,339,321 | 9/1967 | Schmidt | 52/66 |
| 3,626,438 | 12/1971 | Cornell | 52/191 |
| 3,788,016 | 1/1974 | Richardson | 52/66 |
| 4,364,206 | 12/1982 | Wybauw | 52/79.1 |
| 4,468,901 | 9/1984 | Henderson et al. | 52/79.6 |
| 4,691,484 | 9/1987 | Wilson | 52/79.5 |
| 4,747,243 | 5/1988 | Anstead | 52/79.6 |

FOREIGN PATENT DOCUMENTS

| | | | |
|---|---|---|---|
| 778542 | 2/1968 | Canada | 52/79.1 |

*Primary Examiner*—Michael Safavi
*Attorney, Agent, or Firm*—Jerry T. Kearns

[57] ABSTRACT

A modular porch for a mobile home has vertically adjustable support legs which allow the modular porch to be mounted on a hill side and positioned adjacent the doorway of a wide variety of mobile homes. The modular porch utilizes four vertical support legs, each of which is independently axially adjustable. The modular porch has a stairway which is pivotally mounted to allow adjustment to match the surrounding terrain.

1 Claim, 4 Drawing Sheets

MODULAR PORCH FOR A MOBILE HOME

BACKGROUND OF THE INVENTION

1. Field of the Invention

The present invention relates to porches, and more particularly pertains to a new and improved modular porch for a mobile home. The conventional forms of mobile homes are not provided with porches at the entrance doorway. The provision of an attached outwardly extending porch would necessarily increase the width of the mobile home to an extent preventing transportation of the home over public highways. Thus, when a mobile home has been transported to the intended location, it is necessary for the home owner to construct a porch from conventional building materials. This task is time consuming and expensive. Additionally, if it is desired to move the mobile home to another location, the conventionally constructed porch must be torn down. This results in additional waste and expense. In order to overcome these problems, the present invention provides a modular porch which may be easily assembled and disassembled, and is provided with adjustable support legs for use on a wide variety of conventional mobile homes and sloping terrains.

2. Description of the Prior Art

Various types of mobile homes with porches are known in the prior art. A typical example of such a mobile home construction is to be found in W. MacDonald Jr. U.S. Design Pat. No. 148,808, issued on Feb. 24, 1948. This patent discloses a mobile home provided with an integrally formed collapsible porch. C. Bergstrom U.S. Design Pat. No. 171,244, issued on Jan. 5, 1954, discloses a portable house formed from modular sections. C. Wait U.S. Design Pat. No. 176,166, issued et al on Nov. 22, 1955, discloses a mobile home provided with an expansible section. G. Chase U.S. Design Pat. No. 177,086, issued on Mar. 13, 1956, discloses a mobile camping trailer which is provided with laterally extendable sections. Z. Seidel U.S. Design Pat. No. 182,692, issued to Apr. 29, 1958, discloses a mobile home provided with a laterally expandable section. M. Zipursky U.S. Design Pat. No. 193,549, issued et al on Sept. 11, 1962, discloses a mobile home provided with a laterally expandable entrance way. G. Thomas U.S. Design Pat. No. 206,871, issued et al on Feb. 7, 1967, discloses a mobile home provided with laterally expandable sections. J. Gruner U.S. Design Pat. No. 220,319, issued on Mar. 30, 1971, discloses a mobile home mounted on a railroad carriage which is provided with an integrally formed porch.

While the above mentioned devices are suited for their intended usage, none of these devices discloses a modular porch for a mobile home which is provided with adjustable support legs and an adjustable stairway for allowing usage on a wide variety of sloping terrains. Inasmuch as the art is relatively crowded with respect to these various types of porches, it can be appreciated that there is a continuing need for and interest in improvements to such porches, and in this respect, the present invention addresses this need and interest.

SUMMARY OF THE INVENTION

In view of the foregoing disadvantages inherent in the known types of porches now present in the prior art, the present invention provides an improved modular porch for a mobile home. As such, the general purpose of the present invention, which will be described subsequently in greater detail, is to provide a new and improved modular porch for a mobile home which has all the advantages of the prior art porches and none of the disadvantages.

To attain this, a representative embodiment of the concepts of the present invention is illustrated in the drawings and makes use of vertically adjustable support legs which allow the modular porch to be mounted on a hill side and positioned adjacent the doorway of a Wide variety of mobile homes. The is independently axially adjustable. The modular porch has a stairway which is pivotally mounted to allow adjustment to match the surrounding terrain.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved modular porch for a mobile home which has all the advantages of the prior art porches and none of the disadvantages.

It is another object of the present invention to provide a new and improved modular porch for a mobile home which may be easily and efficiently manufactured and marketed.

It is a further object of the present invention to provide a new and improved modular porch for a mobile home which is of a durable and reliable construction.

An even further object of the present invention is to provide a new and improved modular porch for a mobile home which is susceptible of a low cost of manufacture with regard to both materials and labor, and which accordingly is then susceptible of low prices of sale to the consuming public, thereby making such porches economically available to the buying public.

Still yet another object of the present invention is to provide a new and improved modular porch for a mobile home which provides in the apparatuses and methods of the prior art some of the advantages thereof, while simultaneously overcoming some of the disadvantages normally associated therewith.

Still another object of the present invention is to provide a new and improved modular porch for a mobile home which may easily be disassembled for transportation.

Yet another object of the present invention is to provide a new and improved modular porch for a mobile home which is adjustable to allow usage on sloping terrains and with a wide variety of conventional mobile home configurations.

Even still another object of the present invention is to provide a new and improved modular porch for a mobile home which is provided with vertically adjustable support legs and a pivotally adjustable stairway for allowing usage on a variety of sloping terrains and with a wide variety of conventional mobile home configurations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
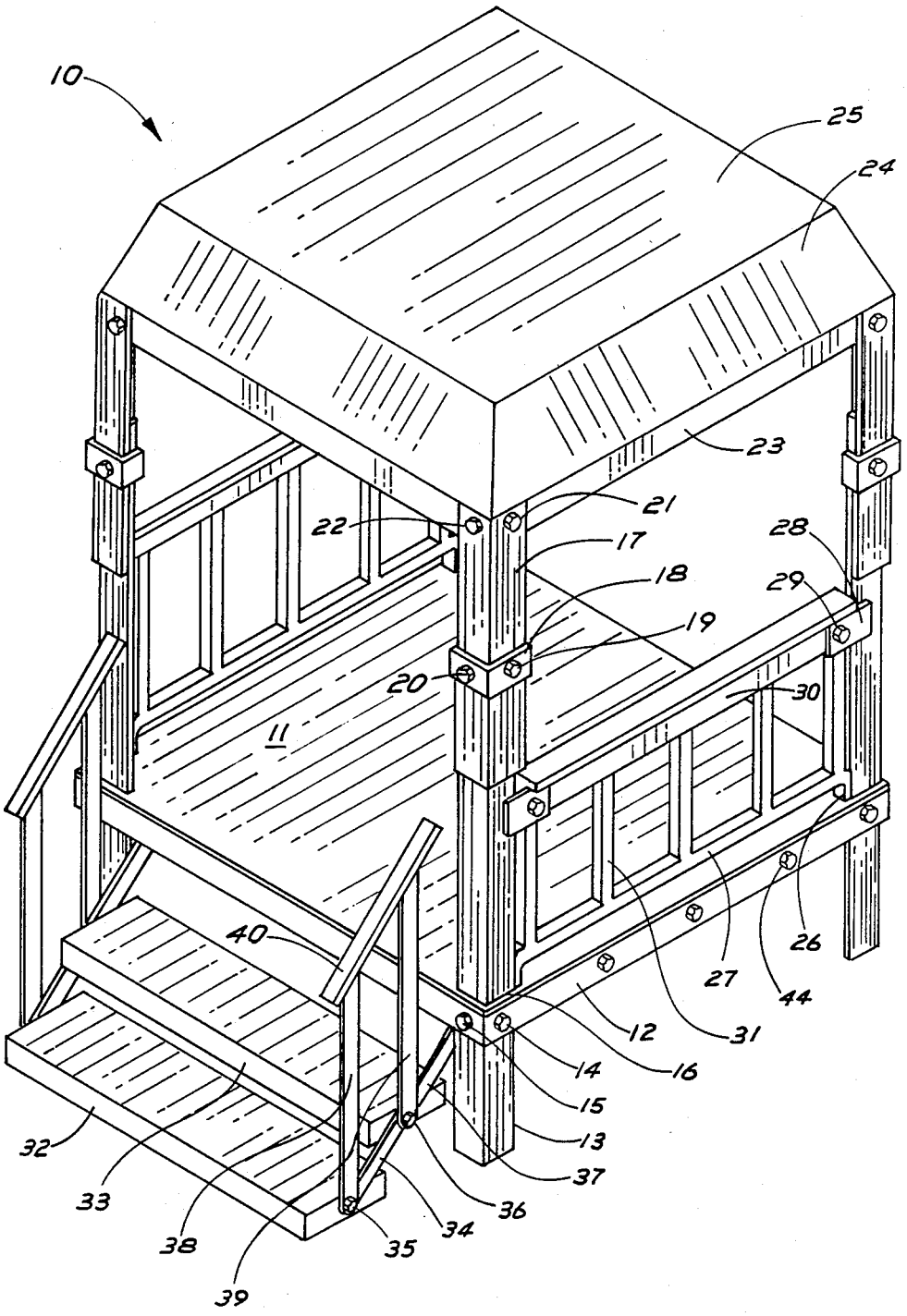
FIG. 1 is a perspective view of the modular mobile home porch of the present invention.

With reference now to the drawings, and in particular to FIG. 1 thereof, a new and improved modular porch for a mobile home embodying the principles and concepts of the present invention and generally designated by the reference numeral 10 will be described.

More specifically, it will be noted that the first embodiment 10 of the invention includes a square planar floor 11. The floor 11 is supported by four peripheral support rails 12 which are secured between vertical support legs 13. Bolts 14 and 15 are illustrated securing end portions of two support rails 12 to the vertical support leg 13. As the construction of the modular porch of the present invention is identical at each corner portion, the constructional details will be described with respect to only one corner portion thereof. The floor support rails 12 are formed from ninety degree angle strips, with one leg portion of each rail 12 visible in FIG. 1, and the other leg portion extending in parallel relation beneath the floor 11. The vertical support legs 13 are also formed from a right angle channel strip and extend through a right angle slot 16 formed through the floor 11. The vertical support leg 13 is received in telescoping overlapping relation with a roof support leg 17. The support leg 13 is secured in adjusted position to the roof support leg 17 by a clamp 18 and clamp bolts 19 and 20. The roof support legs 17 are secured at each corner to a right angle channel roof support strip 23 by bolts 21 and 22. The roof support channel strips 23 provide support for a roof 25 having sloping eaves 24. Side railings 27 are secured in parallel relation on opposed sides of the porch 10. Each of the side railings 27 has a pair of vertically extending tapered mounting legs 26 which are each in abutment with the floor 11 and one of the vertical support legs 13. Each of the side railings 27 has a top rail 30 which is connected by a plurality of vertical supports 31 to a bottom rail. The top rail is provided at opposite ends with a pair of clamping brackets 28 which are each secured to one of the vertical support legs 13 by a clamping bolt 29. A stairway is adjustably attached at a front of the porch by a pair of pivotal support bars 37. As the constructional details at each side of the stairway are identical, these details will be described and referenced in the drawings with respect to only one side thereof. The support bar 37 is attached for pivotal adjustment to the vertical support leg 13 by a conventional bolt. The support bar 37 is pivoted to the desired position and the bolt is tightened. A pair of hand rail supports 38 and 39 are pivotally connected by bolts 35 and 36 to the lower portion 34 of the support bar 37 and also to a pair of stair treads 32 and 33. A hand rail 40 is attached at the upper ends of the supports 38 and 39. As may now be readily understood, the porch 10 of the present invention may be adjusted to fit any sloping terrain by independent adjustment of the vertical support legs 13 and by adjustment of the supporting bars 37 and hand rail supports 38 and 39.

Figure 2:
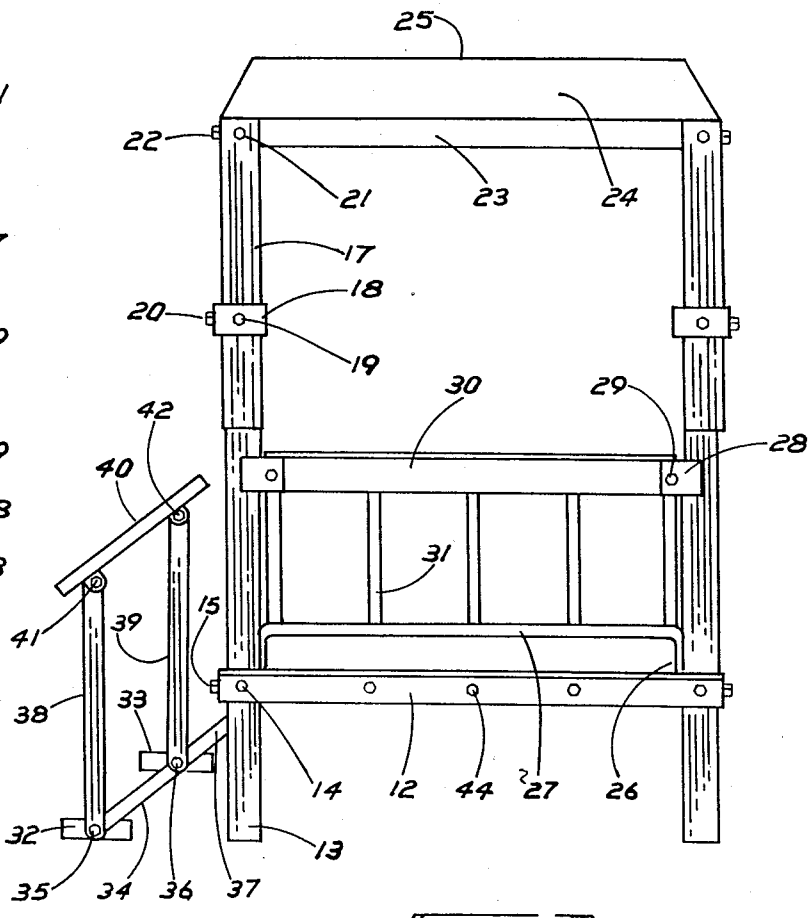
FIG. 2 is a side view of the modular mobile home porch of the present invention.

FIG. 2 provides a side view of the porch 10 of the present invention, which illustrates attaching bolts 41 and 42 which secure the hand rail 4 to the hand rails supports 38 and 39. A plurality of bolts 44 spaced along each of the floor support rails 12 are utilized to mount transversely extending floor support joists.

Figure 3:
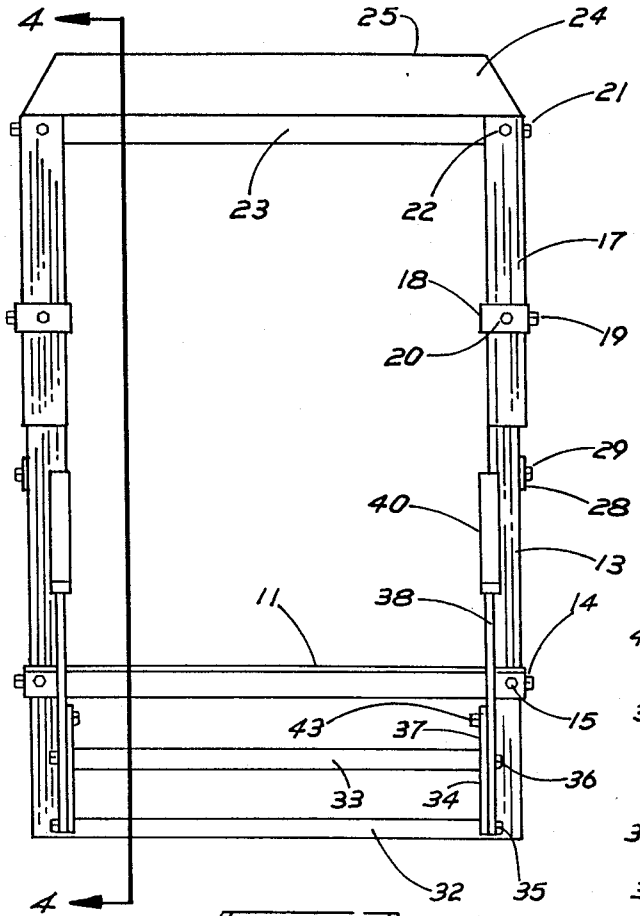
FIG. 3 is a front view of the modular mobile home porch of the present invention.

In FIG. 3, a front view of the porch 10 of the present invention is provided. The bolts 43 which attach the upper ends of the stair support bars 37 to the vertical support legs 13 are illustrated.

Figure 4:
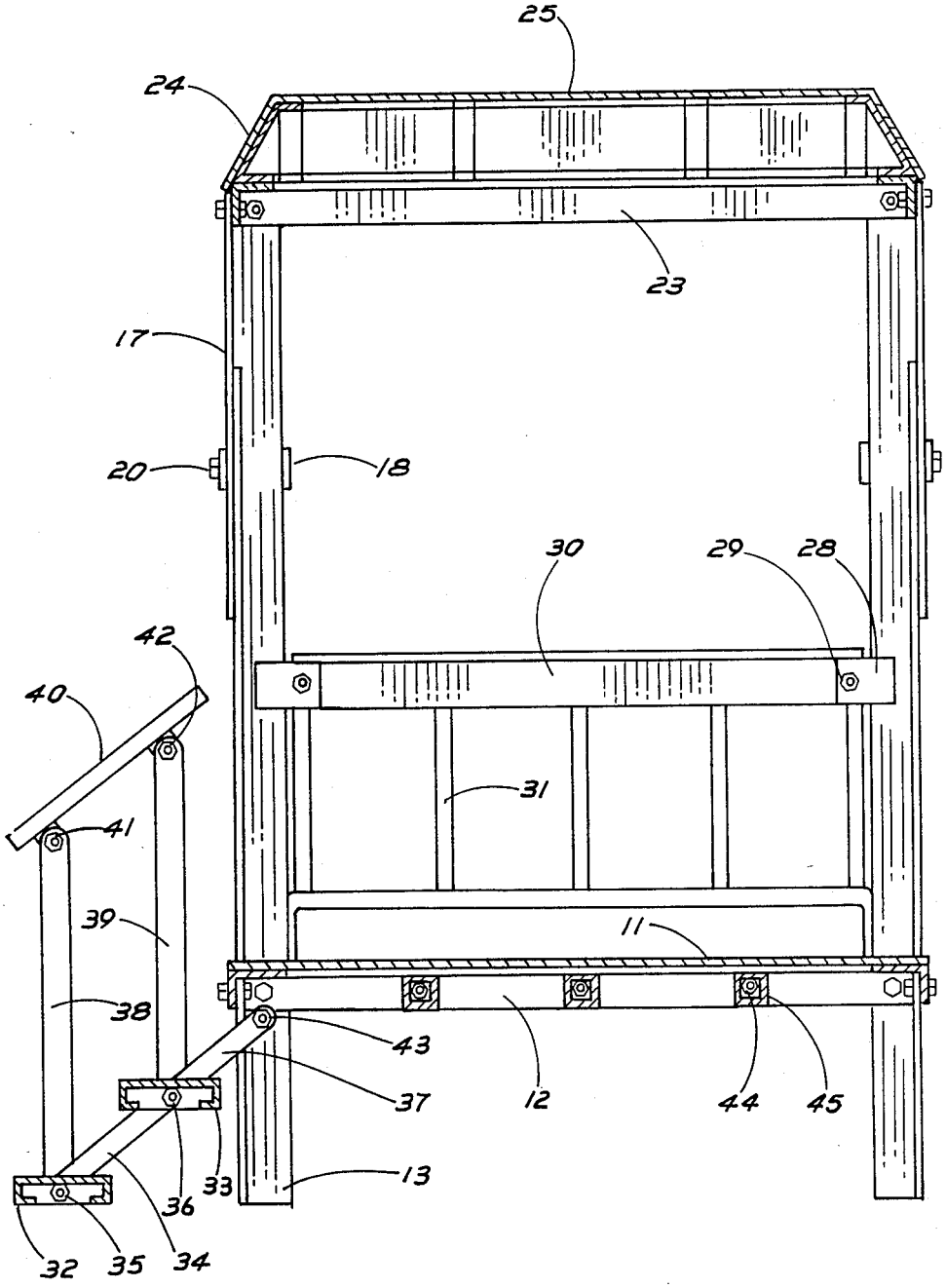
FIG. 4 is a cross sectional view, taken along line 4—4 of FIG. 3.

Figure 4 depicts a cross sectional view, taken along line 4—4 of FIG. 3. A plurality of floor support joists 45 extend in spaced relation between two of the four floor support rails 12. These joists 45 are in the form of rectangular boxed beams and are attached by a plurality of bolts 44. As illustrated, the roof 25 is provided with sloping eaves 24 and is constructed as a modular unit. The roof 25 is supported by right angle channel roof support rails 23 which are secured to vertical roof support legs 17.

Figure 5:
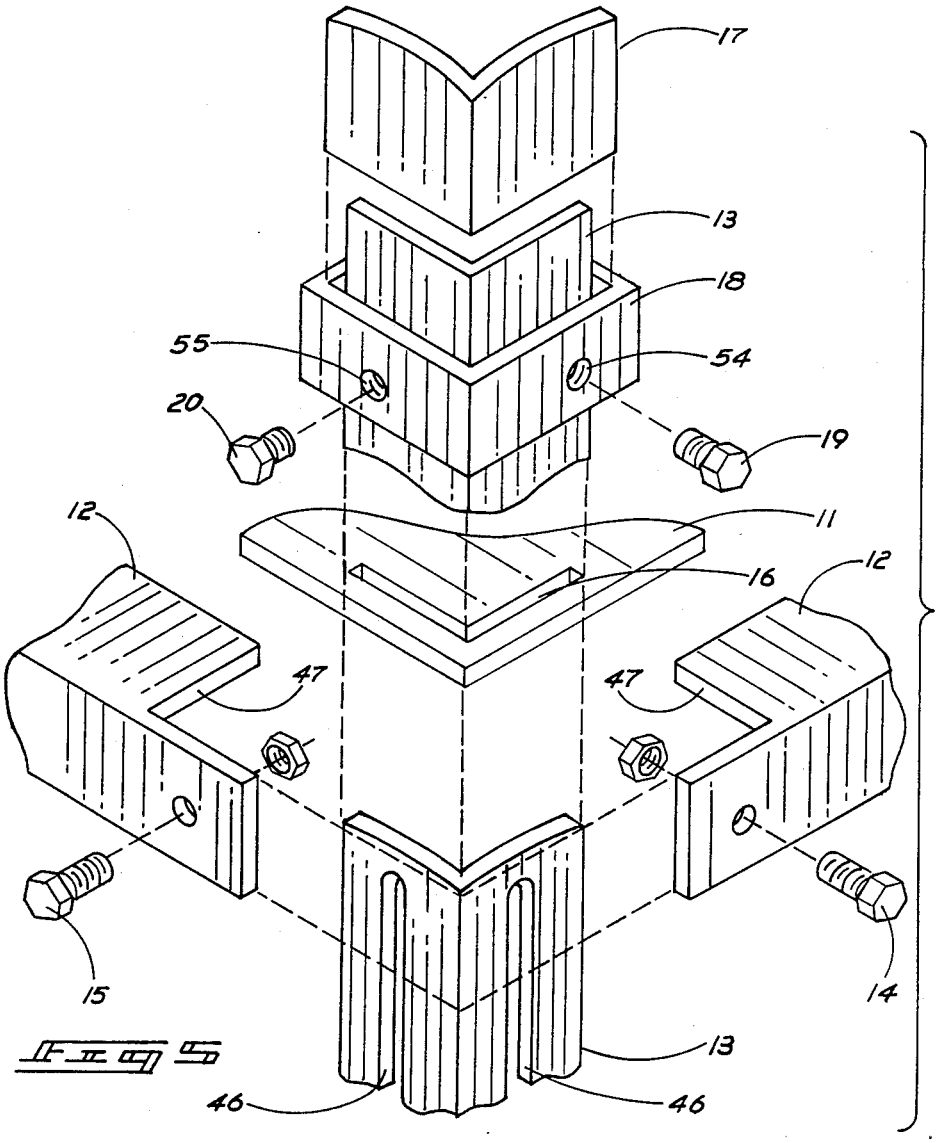
FIG. 5 is an exploded perspective detail view illustrating the construction of the adjustable support legs of the modular mobile home porch of the present invention.

In FIG. 5, an exploded perspective detail view is illustrated, which depicts the assembly of the vertical support leg 13 to the planar floor 11. The lower portion of the right angle channel shaped vertical support leg 13 is provided with a pair of elongated slots 46. The lower portion of the vertical support leg 13 is secured at a desired elevation to the floor support rails 12. As shown, each floor support rail 12 is formed from a right angle channel strip and is provided with a rectangular notched out portion 47. Each floor support rail 12 is secured to the vertical support leg 13 by a bolt 14,15 which extends through one of the slots 46. The vertical support leg 13 is received for sliding movement through a right angle slot 16 formed through the corner portion of the floor 11. The upper portion of the vertical support leg 13 is received in overlapping telescoping relation with the bottom portion of the roof support leg 17 within a clamp 18. The upper portion of the vertical support leg 13 is secured in adjusted position with respect to the roof support leg 17 by a pair of clamping bolts 19 and 20 which extend through threaded apertures 54 and 55 in the clamp 18. As is now apparent, this arrangement provides an independent dual adjustment which allows the height of the floor 11 to be adjusted independently at each corner via the elongated slots 46, and also allows the height of the roof support legs 17 to be independently adjusted at each corner via the clamp 18.

Figure 6:
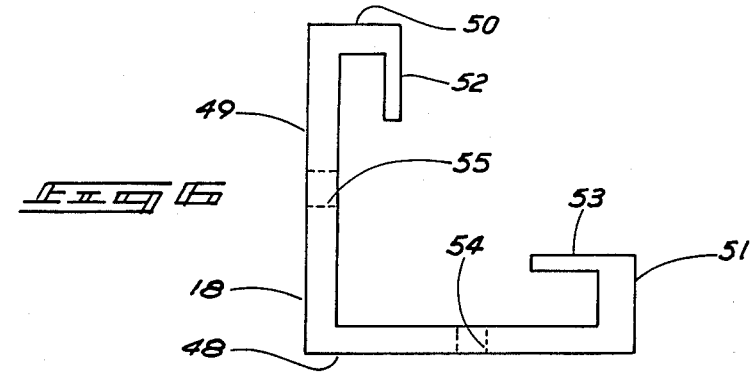
FIG. 6 is a top view illustrating the adjustable support leg clamp.

In FIG. 6, a top view is provided which illustrates the shape of the clamp 18. The clamp 18 is formed from two leg portions 48 and 49 which extend in transverse relation. The leg 48 is provided with a transversely extending leg portion 51 which is integrally formed with a retaining portion 53 which extends in parallel relation to the leg 48. The leg portion 49 is identically provided with a transversely extending leg portion 50 which is integrally formed with a retaining portion 52 which extends in spaced parallel relation to the leg 49. In use, the right angle channel shaped legs 13 and 17 are received in overlapping telescoping relation between the legs 49 and 52 and between the legs 48 and 53. By tightening the clamping bolts 19 and 20 (FIG. 5) into engagement with the leg 17, the legs 13 and 17 will be frictionally clamped against the retaining portions 52 and 53. By loosening the clamping bolts 19 and 20, the relative vertical positions of the legs 13 and 17 may be adjusted as desired.

The components of the porch 10 of the present invention are preferably formed from a rigid sheet metal which may be painted or otherwise conventionally treated for corrosion resistance. This allows the various components to be quickly disassembled and reassembled for purposes of transportation. The porch 10 may be easily and quickly assembled and adjusted for use with a wide variety of conventional mobile homes situated on a variety of variously sloping terrains. The porch 10 of the present invention may be oriented as desired with respect to the entrance door of the mobile home, to provide a front or side entrance as desired.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A modular porch for a mobile home, comprising:

a floor;

a plurality of vertically adjustable support legs connected to said floor;

a plurality of roof support legs adjustably connected to said vertically adjustable support legs;

a roof mounted by said roof support legs;

a vertically adjustable stairway connected to said vertically adjustable support legs;

said adjustable stairway having a pair of space support bars mounted for pivotal adjustment on said vertically adjustable support legs;

a pair of stair treads mounted in parallel spaced relation between said support bars;

a pair of vertical hand rail supports pivotally secured to each of said support bars adjacent opposed end portions of said stair treads;

a pair of hand rails secured at opposite sides of said stairs treads;

means for independently adjusting the height of said floor and the height of said roof with respect to each of said vertically adjustable support legs;

each of said vertically adjustable support legs formed from a right angle channel strip extending through a right angle slot in said floor;

a plurality of right angle floor support rails extending around a periphery of said floor;

said roof support legs each formed from a right angle channel strip and each receiving an upper end portion of one of said vertically adjustable support legs in telescoping relation;

a plurality of clamps for securing said vertically adjustable support legs to said roof support legs;

each of said clamps having first and second leg portions connected in perpendicular relation;

a first retaining leg portion connected in space parallel relation to said first leg portion by a first transverse leg portion at a free end of said first leg portion;

a second retaining leg portion connected in spaced parallel relation to said second leg portion by a second transverse leg portion at a free end of said second leg portion, a threaded aperature extending through a midpoint of each of said first and second leg portions receiving a threaded clamping bolt for frictional engagement with said vertically adjustable and roof support legs;

a rectangular notch formed adjacent each end of said floor support rails;

a pair of elongated slots formed through a lower end portion of each of said vertically adjustable support legs;

and means for securing said floor support rails to said slotted vertically adjustable support leg lower end portions.

* * * * *